US006343622B1

(12) United States Patent
Keijzer et al.

(10) Patent No.: US 6,343,622 B1
(45) Date of Patent: Feb. 5, 2002

(54) FLOW-THROUGH CONNECTION MEMBER FOR AN EXPANSION TANK

(75) Inventors: Wilhelmus Franciscus Maria Keijzer, Zutphen; Stephan Johannes Lutje Beekhuis, Bunscholen, both of (NL)

(73) Assignee: Flamco b.v., Gouda ( * ) Notice: Subject to any disclaimer, the term of this patent is extended or adjusted under 35 U.S.C. 154(b) by 0 days.

(21) Appl. No.: 09/540,962

(22) Filed: Mar. 31, 2000

(51) Int. Cl.[7] ..... F15D 1/02
(52) U.S. Cl. ..... 138/39; 138/30
(58) Field of Search ..... 138/39, 30, 31

(56) References Cited

U.S. PATENT DOCUMENTS

| | | | | | |
|---|---|---|---|---|---|
| 3,857,413 | A | * | 12/1974 | Zahid | 138/30 |
| 3,868,972 | A | * | 3/1975 | Zirps | 138/30 |
| 4,043,425 | A | * | 8/1977 | Schützer | 184/55 A |
| 4,069,844 | A | * | 1/1978 | Zahid | 138/30 |
| 4,112,978 | A | * | 9/1978 | Olbrich et al. | 138/30 |
| 4,136,714 | A | * | 1/1979 | Jones | 138/30 |
| 4,178,965 | A | * | 12/1979 | Zahid | 138/30 |
| 4,298,030 | A | * | 11/1981 | Mercier | 138/30 |
| 4,807,721 | A | * | 2/1989 | Fujiwara | 138/39 |

FOREIGN PATENT DOCUMENTS

| | | |
|---|---|---|
| DE | 85 07 703.8 | 3/1985 |
| DE | 195 29 959 A1 | 8/1995 |
| DE | 196 09 375 C1 | 2/1996 |
| DE | 296 21 353 U1 | 12/1996 |

* cited by examiner

*Primary Examiner*—James Hook
(74) *Attorney, Agent, or Firm*—Barry G. Magidoff

(57) ABSTRACT

A flow-through member (1), which is suitable for being positioned in a connecting passage of an expansion tank in order to define a first flow-through passage (30) and a second flow-through passage (40), and which comprises a basic part **(1*a*), by way of which the flow-through member (1) can be secured in the connecting passage, and a flow-guidance element (14) which is movably connected to the basic part (1*a*) and has an inlet opening (8) which can direct itself towards the upstream direction of a flow which is present in the flow passage 50** at least during operation.

9 Claims, 2 Drawing Sheets

FLOW-THROUGH CONNECTION MEMBER FOR AN EXPANSION TANK

The invention relates to a flow-through member for an expansion tank for permitting circulating liquid flow between an expansion tank and a liquid flow system.

A flow-through member of this nature is known, for example, from DE 296 21 353-U. When secured in the connecting passage, the flow-through member forms at least two passages in the connecting passage of the expansion tank. With the aid of a conventional connection piece, a through-flow expansion tank which is formed in this way is connected to a pipe of a water supply system. The flow-through member projects through a connection socket of the connection piece, one end of the flow-through member extending all the way into a flow passage in the water supply system. An inlet opening and an outlet opening are arranged in the corresponding end, which openings are on opposite sides of the end of the flow-through member, with their axes substantially parallel to the centre axis of the flow passage.

A drawback of the known flow-through member is that it is extremely complex and is therefore expensive to produce.

Another drawback of the known flow-through member is that it has to be positioned in a predetermined orientation in the connection piece so that it has the proper orientation in the flow passage of the water supply system.

The object of the present invention is to provide a flow-through member which does not have the abovementioned drawbacks.

This object is achieved with a flow-through member having a movable, preferably rotatable, flow-guidance element, which moves to face upstream, if the direction of flow changes.

The flow-through member according to the invention is relatively simple and therefore inexpensive. The orientation of the flow-guidance element can be independent of the orientation of the basic part.

The invention also relates to an expansion tank provided with a flow-through member according to the invention.

BRIEF DESCRIPTION OF THE DRAWINGS

The following description of preferred embodiments of a flow-through element according to the invention, and the appended drawings are provided to exemplify the present invention, but are not intended to be exclusive thereof, in the drawings:

The flow-through member 1 which is shown in FIG. 1 comprises a basic part 1*a* with a cylindrical sleeve 4 which is preferably circular in cross section. One end of the cylindrical sleeve 4 has a flange edge 5, by means of which the basic part 1 a can bear against an internal surface of an expansion tank 3 (cf. FIG. 2). That end of the cylindrical sleeve 4 which is provided with the flange edge 5 forms a first connection end of the flow-through member 1, by means of which the flow-through member 1 can be placed in communication with a liquid-holding space of the expansion tank 3 in which the flow-through member 1 is mounted. The opposite end of the flow-through member 1 forms a second connection end, by means of which the flow-through member 1 can be placed in communication with a flow passage of a water supply system.

Figure 1:
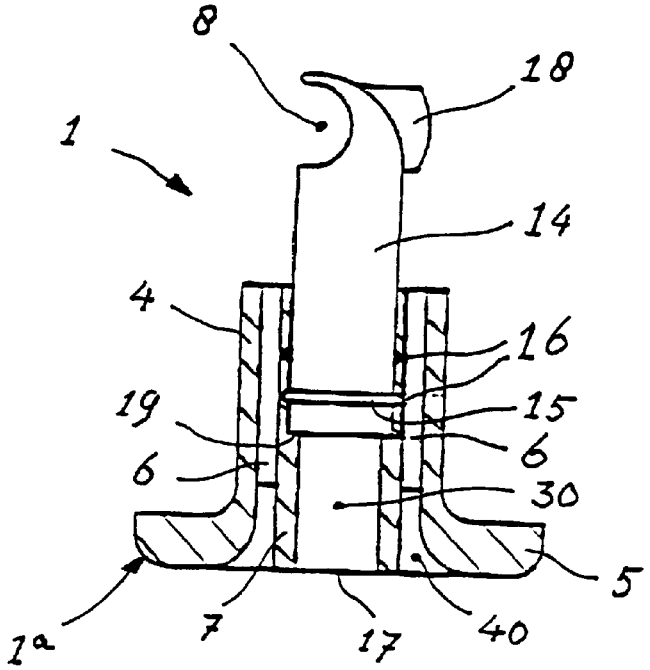
FIG. 1 shows a cross-sectional view of a preferred embodiment of a flow-through member.

The outside contour of the cylindrical sleeve 4 substantially corresponds to the inside contour of the connection nipple 2 of the expansion tank 3 in question, the connection nipple 2 defining a connecting passage of the expansion tank 3. The cylindrical sleeve 4 can be fitted into the connection nipple 2, and friction between an inner surface of the connection nipple 2 and an outer surface of the cylindrical sleeve 4 brings about coupling between the cylindrical sleeve 4 and the connection nipple 2. The coupling can be made stronger by arranging elastically deformable clamping edges on the outer circumference of the cylindrical sleeve 4, so that the cylindrical sleeve 4 can be fixed immovably in the connection nipple by means of a press-fit. The cylindrical sleeve 4 preferably extends from the inner surface of the expansion tank 3 to an outer edge of the connection nipple 2.

The basic part 1 a furthermore comprises an inner sleeve 7 which is preferably arranged concentrically in the cylindrical sleeve 4. Spacers 6 ensure that the inner sleeve 7 is positioned concentrically in the cylindrical sleeve 4.

The space inside the inner sleeve 7 forms at least part of a first flow-through passage 30, and the space between the cylindrical sleeve 4 and the inner sleeve 7 forms a second flow-through passage 40.

The inner sleeve 7 preferably extends from the first connection end of the flow-through member 1 to the plane of the outer edge of the connection nipple 2.

A preferably tubular flow-guidance element 14 is arranged in the inner sleeve 7. In the preferred embodiment of the flow-through member according to the invention which is illustrated, the flow-guidance element 14 is arranged rotatably in the inner sleeve 7. The inner sleeve 7 has an internal diameter which is stepped, so that a stop 19 is formed, defining the maximum depth for the flow-guidance element 14 to be placed in the inner sleeve 7. An axial stop is provided to prevent the flow-guidance element 14 from being able to slide out of the inner sleeve 7; for example, an encircling rib 15 is arranged on the outer circumference of the flow-guidance element 14, in the vicinity of that end of the flow-guidance element 14 which has been pushed into the inner sleeve 7. An associated groove 16, which interacts with the rib 15 in order to lock the flow-guidance element 14 in the inner sleeve 7, is arranged in the inner wall of the inner sleeve 7. The dimensions of the rib 15 and the groove 16 allow a rotary movement of the flow-guidance element 14. Obviously, the rib 15 may also be arranged on the inner wall of the inner sleeve 7, with the associated groove 16 on the outer circumference of the flow-guidance element 14.

To allow elastic deformation of the flow-guidance element 14 when it is arranged in the inner sleeve 7, the flow-guidance element 14 may have an incision which extends from the end which has been pushed into the inner sleeve 7, over a predetermined distance in the longitudinal direction of the flow-guidance element 14. The flow-guidance element 14 is fitted into the inner sleeve 7 from the side of the second connection end of the flow-through member 1.

Preferably, two or more grooves 16 are formed in the inner wall of the inner sleeve 7. In this way, it is possible to adapt the distance by which the flow-guidance element 14 extends outside the basic part 1 a to a connecting member which is used to connect the expansion tank in which the flow-through member 1 is arranged to the water supply system. The free end of the flow-guidance element 14 lies at a distance from the basic part 1*a*. At the free end, an inlet opening 8 is arranged on the circumference of the tubular flow-guidance element 14. At the free end the flow-guidance element 14 has a bended end wall which also defines a part of the contour of the inlet opening 8 (FIG. 1). The inlet opening allows water to flow into the flow-guidance element 14, the direction of flow as the water flows in forming an angle with the centre axis of the flow-guidance element 14. The free end of the flow-guidance element 14 is shaped in such a way that a liquid which is flowing inwards through the inlet opening 8 at least during operation flows to the first connection end of the flow-through member 1 via the first flow-through passage 30.

If an expansion tank which is provided with a flow-through member 1 according to the invention is used in a water supply system, the expansion tank is connected to the water supply system in such a manner that the first connection end of the flow-through member 1 is in communication with a flow passage in the water supply system. The flow-guidance element 14 projects sufficiently beyond the basic part 1 a that the free end which has the inlet opening 8 is located in the flow passage in question, all this in such a manner that the element 14 can rotate to have the outlet opening can direct itself towards the upstream direction of a flow which is present in the flow passage at least during operation.

Figure 2:
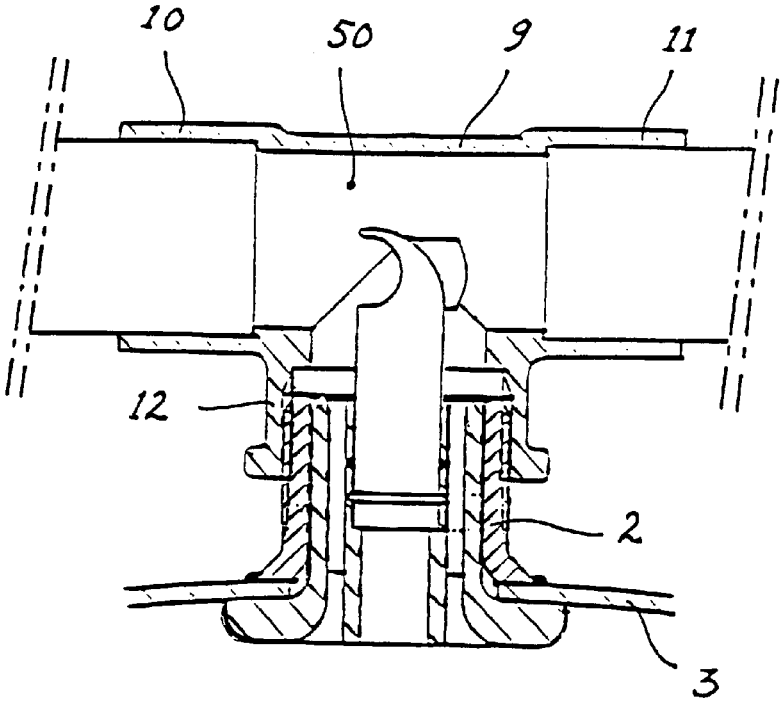
FIG. 2 shows a cross-sectional view of the flow-through member shown in FIG. 1, which is arranged in a connection nipple of an expansion tank which is connected to a water supply system.

FIG. 2 shows part of the expansion tank 3 (in cross section) in which a flow-through member 1 according to the invention is arranged. During assembly of the expansion tank 3, the basic part 1*a* is pressed into the connection nipple 2 of the expansion tank 3 so far that the flange edge 5 bears against the inner wall of the expansion tank 3.

The connection nipple 2 is provided with an external screw thread, so that the expansion tank 3 can be screwed into a suitable connecting means of a water supply system.

The expansion tank shown in FIG. 2 is connected to the water supply system with the aid of a conventional T-piece 9. The T-piece 9 has a first connection sleeve 10 and a second connection sleeve 11 which are coaxial and between which a main flow passage 50 is formed. The T-piece 9 also has a connection socket 12, the centre axis of which is preferably perpendicular to the common centre axis of the first connection sleeve 10 and the second connection sleeve 11. Moreover, the connection socket 12 is provided with an internal screw thread, by means of which the T-piece 9 can be screwed onto the connection nipple 2, which is provided with an external screw thread, of the expansion tank 3.

When the T-piece 9 has been screwed on to the connection nipple 2, the free end of the flow-guidance element 14 which has the inlet opening 8 is situated between the first connection sleeve 10 and the second connection sleeve 11, in the main flow passage 50. The free end of the flow-guidance element 14 is preferably located substantially at the level of the common centre axis of the first connection sleeve 10 and the second connection sleeve 11. In the position shown in FIG. 2, the inlet opening 8 faces towards the first connection sleeve 10.

If water flows from the first connection sleeve 10, via the main flow passage 50, towards the second connection sleeve 11, at least some of the water will flow through the inlet opening 8 in the flow-guidance element 14 and will be diverted towards the expansion tank 3. To achieve this effect, a surface which is defined by the contour of the inlet opening 8 has a projected surface which lies on a plane which is perpendicular to the centre axis of the flow passage 50. The thrust pressure causes an increase in pressure in the first flow-through passage 30, while in the downstream direction of the main flow through the T-piece 9 the pressure of the water is reduced with respect to the flow-guidance element 14. This results in flow from the first flow-through passage 30, via an axial opening 17 in the inner sleeve 7, at the first connection end of the flowthrough member 1, through the second flow-through passage 40 to the main flow passage 50. At the level of the flange edge 5, the water flowing out of the axial opening 17 flows radially outwards and then back through the second flow-through passage 40 towards the flow passage 50.

In order to ensure that the flow-guidance element 14 is positioned correctly, with the inlet opening 8 facing upstream, a directing element 18 is arranged on the outer surface of the flow-guidance element 14, in the vicinity of the free end. When water flows past the directing element 18, the water exerts a force which is directed in the direction of flow on the directing element 18. If the surface of the directing element 18 forms an angle with the direction of flow of the flowing water, the force which the water exerts on the directing element 18 causes a moment force, with the result that the flow-guidance element 14 rotates until the surface of the directing element 18 substantially coincides with the direction of flow. The directing element 18 thus acts as a vane.

The expansion tank 3 having the flow-through member 1 according to the invention is suitable for any system of pipes which has a connection socket 12 with dimensions which corresponds to the dimensions of the connection nipple 2 of the expansion tank 3. The connection socket 12 may also, for example, be welded directly onto a pipe in the system of pipes. Obviously, the expansion tank 3 may also be connected to the system of pipes in other ways, for example with the aid of a nut.

The cylindrical sleeve 4 and the inner sleeve 7 are concentric in the preferred embodiment illustrated in FIGS. 1 and 2. The inner sleeve 7 is positioned in the cylindrical sleeve 4 with the aid of four spacers 6. The number of spacers is preferably 3 or more, so that the inner sleeve 7 is positioned in the cylindrical sleeve 4 in a stable, vibration-free manner. Preferably, the cylindrical sleeve 4, the spacers 6 and the inner sleeve 7 form a single unit.

Figure 3:
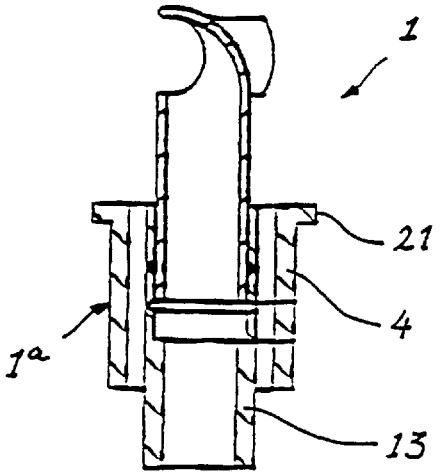
FIG. 3 shows a cross-sectional view of a flow-through member which can be fitted into an expansion tank from the outside.
Figure 4:
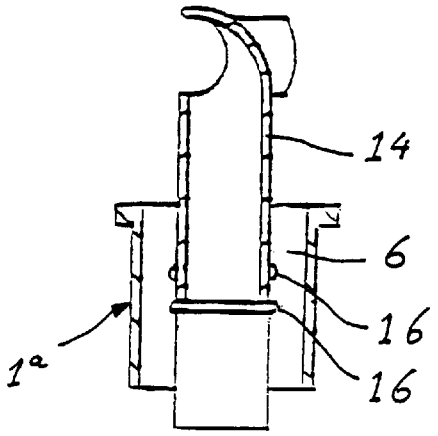
FIG. 4 shows a cross-sectional view of a flow-through member without an inner sleeve.

FIGS. 3 and 4 show two variants of the flow-through member 1, which can be arranged in the connection nipple 2 of the expansion tank 3 if it has not already been provided with the flow-through member 1 during assembly.

The flow-through member 1 shown in FIG. 3 corresponds to the flow-through member 1 shown in FIG. 2, except that the flange edge 5 has been removed from the basic part 1 a and the basic part 1 a is provided with a flange 21 on the side of the second connection end of the flow-through member 1. When the basic part 1 a is mounted in the connection nipple 2, the flange 21 bears against the outer edge of the connection nipple 2. If a suitable material is selected, the flange 21 can be used as a sealing ring between the connection nipple 2 and the connection socket 12.

In the flow-through member 1 illustrated in FIG. 4, the inner sleeve 7 has been eliminated and grooves 16 are arranged in the spacers 6, in which grooves the rib 15 of the flow-guidance element 14 can be positioned. In this case, the flow-guidance element 14 extends at least as far as the first connection end of the flow-through element 1. If desired, openings may be formed in that end of the flow-guidance element 14 which is located in the vicinity of the first connection end, through which openings water can flow in the radial direction.

Figure 5:
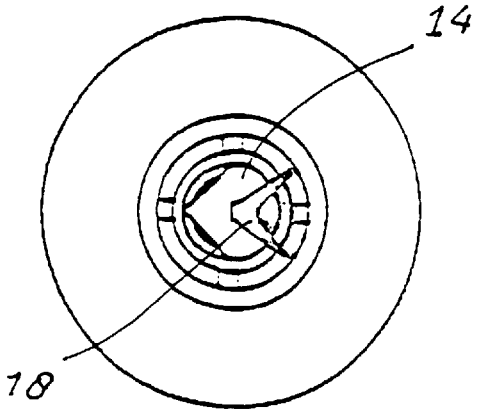
FIG. 5 shows a plan view of a flow-through member with a V-shaped directing element.

FIG. 5 shows the flow-through member 1 shown in FIG. 1, with a V-shaped directing element 18 arranged on the flow-guidance element 14. Consequently, the flow-guidance element 14 will rotate into the correct position more quickly. Moreover, the V-shaped directing element 18 causes downstream turbulence in the water, resulting in a greater difference between the pressure in the first flow-through passage 30 and the pressure in the main flow passage 50 downstream of the flow-guidance element 14. This has a beneficial effect on the flow through the expansion tank 3.

Preferably, the flow-through member according to the invention is made from a material which is simple to process, such as a plastics material. Obviously, the flow-through member may also be made from any other material which is suitable for use in a water supply system, such as stainless steel or brass.

The embodiments described above are given as non-limiting examples. It will be clear to a person skilled in the art that numerous changes and modifications may be made to the exemplary embodiments without departing from the scope of the invention as defined in the appended claims.

For example, it is possible to replace the basic part 1*a* by a sealing ring with spacers in which the flow-guidance element 14 can be rotatably arranged. A flow-through member 1 of this nature can be arranged in an expansion tank which has already been assembled.

Furthermore, the first flow-through passage 30 and the second flow-through passage 40 may be eccentric with respect to one another.

Also, the basic part 1*a* may comprise a solid part with a first hole in which the flow-guidance part 14 can be arranged, and a plurality of drilled holes with a smaller diameter than the diameter of the first hole, in order to allow water flowing through the first hole to flow back.

In another embodiment, the inlet opening 8 and the directing vane 18 are arranged in or on a separate element which is positioned rotatably over an axial opening at the free end of the flow-guidance element 14.

The flow-guidance element 14 may be provided, on the side of the inlet opening 8, with a projecting edge which is perpendicular to the outer circumference and closes off part of the second flow-through passage 40.

What is claimed is:

1. A flow-through member for permitting circulating liquid flow between an expansion tank and a liquid flow system, the flow-through member comprising a basic fluid connection part, for securing the flow-through member to the expansion tank and defining a fluid flow connecting passage, so as to permit flow of liquid through the tank; and a flow-guidance element, which is connected to the basic part and defines an inlet opening with an inlet direction which forms an angle with the centre axis of the flow-guidance element, the basic part and the guidance element of the flow through member defining a first flow-through passage and a second flow-through passage in the connecting passage, characterized in that the flow-guidance element is rotatably connected to the basic part.

2. The flow-through member according to claim 1, wherein the flow-guidance element is substantially cylindrical and is arranged in an axially displaceable manner in the basic part, the basic part being provided with first coupling means which interact with associated second coupling means arranged on the flow-guidance element, so that the flow-guidance element can be arranged in at least two positions, which are axially offset with respect to one another, in the basic part; the coupling means being designed to lock the axial position of the flow-guidance element in the basic part and to allow rotation of the flow-guidance element.

3. The flow-through member according to claim 1, wherein the flow-guidance element is so shaped that liquid flow past it tends to direct the inlet opening towards the upstream direction of a liquid flow around the flow-guidance element.

4. The flow-through member according to claim 3, wherein the flow guidance element further comprises a directing vane.

5. The flow-through member of claim 4, wherein the directing vane is substantially planar and is arranged on a portion of the outer circumference of the flow guidance element which lies opposite to the inlet opening, in a plane running through the centre axis of the flow-guidance element.

6. The flow-through member according to claim 4, wherein the directing vane comprises a directing element which is substantially V-shaped in cross section, the bisector plane of the V-shaped directing element being a plane which runs through the centre axis of the flow-guidance element.

7. The flow-through member according to claim 1, wherein the flow-guidance element comprises a substantially tubular flow part and a rotatable inlet part, a first axial end of the tubular flow part being connected to the basic part, and the rotatable inlet part being arranged at a second axial end, which lies at a distance from the basic part, of the tubular flow part, the inlet part being provided with the inlet opening.

8. An expansion tank provided with a flow-through member according to claim 1.

9. A flow-through member for permitting circulating liquid water flow between an expansion tank and a water supply system, the flow-through member comprising a basic fluid connection part, for securing the flow-through member to the expansion tank and to the water supply system, and defining a connecting passage between the water supply system and the expansion tank, so as to permit flow of liquid from the water supply system and through the tank; and a flow-guidance element, which is connected to the basic part and defines an inlet opening, opening into the water supply system and the inlet opening having an inlet direction which forms an angle with the centre axis of the flow-guidance element, the basic part and the guidance element of the flow through member defining a first flow-through passage and a second flow-through passage in the connecting passage, the inlet opening being in fluid flow connection to only one of the first and second flow-through passages, the flow-through member characterized in that the flow-guidance element is movably connected to the basic part, so that the inlet opening is caused to face into the water flow in the water supply system as the direction of flow may change in the water supply system.

* * * * *